US005444948A

United States Patent [19]

Trapp

[11] Patent Number: 5,444,948

[45] Date of Patent: Aug. 29, 1995

[54] ADJUSTABLE ARCH SUPPORT

[76] Inventor: William B. Trapp, 135 Madden Run Rd., New Galilee, Pa. 16141

[21] Appl. No.: 194,504

[22] Filed: Feb. 9, 1994

[51] Int. Cl.[6] ..... E04G 21/26

[52] U.S. Cl. ..... 52/127.2; 52/89

[58] Field of Search ..... 405/146, 251, 288, 290, 405/291; 52/749, 127.2, 89, 85, 88, 127.1

[56] References Cited

U.S. PATENT DOCUMENTS

| | | | |
|---|---|---|---|
| 862,418 | 8/1907 | Street | 52/89 |
| 1,630,589 | 5/1927 | Taber . | |
| 2,055,876 | 9/1936 | Newman | 405/288 |
| 3,403,486 | 10/1968 | Schubeis | 52/127.2 |
| 3,812,680 | 5/1974 | Walbrohl . | |
| 4,618,283 | 10/1986 | Hilfiker . | |
| 4,826,639 | 5/1989 | Vidal et al. | 52/89 |
| 5,329,743 | 7/1994 | Legnante | 52/749 |

FOREIGN PATENT DOCUMENTS

| | | |
|---|---|---|
| 1513143 | 2/1968 | France . |
| 1656135 | 6/1991 | Russian Federation . |
| 1227317 | 4/1971 | United Kingdom . |

*Primary Examiner*—Randolph A. Reese
*Assistant Examiner*—Frederick L. Lagman
*Attorney, Agent, or Firm*—Richard C. Litman

[57] ABSTRACT

An adjustable arch support for use in brick and other masonry construction provides temporary support of a brick or masonry arch during construction. The support provides for adjustment for both width and height, for use in masonry openings of various sizes and shades. A header includes plural fingers extending vertically upward therefrom, with the fingers also being vertically adjustable. Each of the fingers includes a brick or masonry support pivotally attached to the upper end thereof, providing for angular adjustment to properly support a brick or masonry monolith during construction of the arch. The support is adjusted horizontally and vertically to fit the lower rectangular portion of the arch opening, and the fingers are adjusted vertically to form the proper arch shape. One or several more masonry courses may then be constructed, using the arch support for support until the mortar or cement has cured. The support may then be removed by loosening the adjustments and removed from the opening for repeated use. The support eliminates the need for carpentry work to build single use wood supports which must be destroyed for removal when the mortar has cured.

10 Claims, 3 Drawing Sheets

ADJUSTABLE ARCH SUPPORT

FIELD OF THE INVENTION

The present invention relates generally to construction forms used for the support of partially completed building structures during construction thereof, and more specifically to a portable and reusable, temporarily installable and removable support particularly suitable for the support of a brick or masonry archway during construction. The device is adjustable to fit door, window and/or other openings of various widths and heights, as well as to conform to arches having a variety of shapes.

BACKGROUND OF THE INVENTION

Building construction utilizing bricks, stone, or the like, is dependent upon mortar or other cement to secure the individual blocks of brick or stone together. While the resulting structures are generally quite sturdy and durable, a great deal of their strength is dependent upon the cured mortar or other agent used to cement the blocks together; such a structure is relatively weak until the mortar or other cement cures.

This is especially true where the brick or stonework is used in the construction of an arch over an underlying door, window, or other opening. Such arches have been known in the building trade for thousands of years, and have been found to be capable of supporting a substantial load over an opening when properly constructed. However, this is only true when the arch structure is absolutely rigid and solid. A masonry arch is incapable of supporting even its own weight until the mortar or other cement used to secure the blocks together, has cured.

Heretofore, the building construction trade has generally relied upon support forms constructed of wood to support a masonry arch being constructed, until the mortar or cement is cured. Generally, due to union and other professional and work rules, different workers (i. e., carpenters) must be brought in to construct such wood forms. Consequently, any masonry construction in the immediate area comes to a halt. The construction of such a form or support for a masonry arch may take anywhere from two to several hours, depending upon the size and complexity of the shape, and as permanent fasteners (nails) are used in the construction of the form, each form is destroyed in order to remove it when the masonry arch is completed and the mortar or cement cured. Thus, each form is specific for the particular arch to be constructed, and cannot be reused.

Such wood forms are relatively weak, and can support no more than two or three courses of bricks until the mortar or cement cures and the masonry arch is self supporting. Once again, any masonry work in the immediate vicinity must stop after the very few courses (perhaps only one) of bricks or blocks are laid, until curing is complete, and of course cannot continue while the carpenter(s) is/are knocking out the no longer needed wood support.

As can be seen, the above method of masonry arch construction is extremely wasteful of both time and materials, which equate to the cost of building construction. Accordingly, the need arises for a reusable masonry arch support which is adjustable for different widths and heights of arched openings, as well as for differently shaped (e.g., gothic, semicircular, etc.) arches. The device must provide for ease of installation and removal by masonry crews, thus eliminating the need for other materials and workers.

DESCRIPTION OF THE PRIOR ART

U.S. Pat. No. 1,630,589 issued to William P. Taber on May 31, 1927 discloses a Method Of And Means For Supporting Roof Strata During The Mining Of Minerals. The means comprises a plurality of I beam supports, each of which is formed of two sections hinged together. No peripheral frame is disclosed, nor do any of the supports telescope or provide for the support of an overlying arcuate form or shape, as in the present invention.

U.S. Pat. No. 3,812,680 issued to Heinz-Theo Walbrohl on May 28, 1974 discloses a Shiftable Support For Use In Tunnels, Mines And The Like. The apparatus includes a plurality of horizontal and vertical cross-members, either hydraulically or mechanically disposed to provide compressive forces to a peripheral arch formed of plural elongate sections. No means of telescoping either the horizontal base member nor the peripheral arcuate sections is disclosed; the device must closely fit the surrounding tunnel in order to be operable, as little adjustment is obtainable. Due to the elongate arcuate sections, little variation in the shape of the arch is possible. As the device is intended for tunneling, the arcuate form is relatively deep, rather than lying substantially in a relatively thin plane, as in the present invention.

U.S. Pat. No. 4,618,283 issued to William K. Hilfiker on Oct. 21, 1986 discloses an Archway Construction Utilizing Alternating Reinforcing Mats And Fill Layers. No internal support of the arch or tunnel is disclosed, and the wire mesh mat material is unrelated to the telescoping sections of the present arch support. The overlying mats are in fact depressed in their centers where they are joined together, unlike an arch construction.

British Patent No. 1,227,317 published on Apr. 7, 1971 discloses Improvement In Or Relating To Advancing Roof Supports. Again, no central support is disclosed; only laterally spaced apart peripheral supports are shown. The overlying arch support is a single component and cannot be reshaped for different arch configurations. Moreover, the device includes means securing plural longitudinally spaced supports together, which structure is beyond the scope of the present invention.

French Patent No. 1,513,143 published on Feb. 9, 1968 discloses a machine for the construction of tunnels and the like. The device is mobile, running on plural tracked wheels, and includes a rotatable cutting head array providing for the digging of a tunnel. Support is disclosed for the resulting roof of the tunnel, but comprises a plurality of hydraulic struts; no support of an overhead arch is disclosed.

Finally, Soviet Patent No. 1,656,135 published on Jun. 15, 1991 discloses an extraction machine for use in coal mining or the like. The device is a tracked vehicle, much like the device of the French patent discussed immediately above. No arcuate overlying support is disclosed; such support as is provided is by means of hydraulic rams, unlike the present invention.

None of the above noted patents, taken either singly or in combination, are seen to disclose the specific arrangement of concepts disclosed by the present invention.

SUMMARY OF THE INVENTION

By the present invention, an improved adjustable arch support for the construction of masonry arches or the like, is disclosed.

Accordingly, one of the objects of the present invention is to provide an improved adjustable arch support which is of sturdy construction and which may be reused numerous times, rather than being limited to one time use.

Another of the objects of the present invention is to provide an improved adjustable arch support which provides for both lateral and vertical adjustment by means of telescoping channel members, to provide for use in differently sized and shaped masonry openings.

Yet another of the objects of the present invention is to provide an improved adjustable arch support which includes a plurality of vertically adjustable fingers in order to provide for the construction of masonry arches of various shapes and configurations.

Still another of the objects of the present invention is to provide an improved adjustable arch support which includes pivotally adjustable brick support members to support each of the individual members of a brick or masonry course at the proper angle to form the desired arch.

A further object of the present invention is to provide an improved adjustable arch support which includes graduations providing for the alignment of the bricks or other masonry forming the arch course.

An additional object of the present invention is to provide an improved adjustable arch support which is constructed of aluminum or other material which is light weight for ease of carriage by a masonry worker, and which also provides for ease of cleanup and corrosion resistance.

Another object of the present invention is to provide an improved adjustable arch support which provides for the adjustment of its various components by a masonry worker or bricklayer without the need of additional tools or equipment.

A final object of the present invention is to provide an improved adjustable arch support for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the figures of the attached drawings.

DETAILED DESCRIPTION OF THE PREFERRED EMBODIMENT

Figure 1:
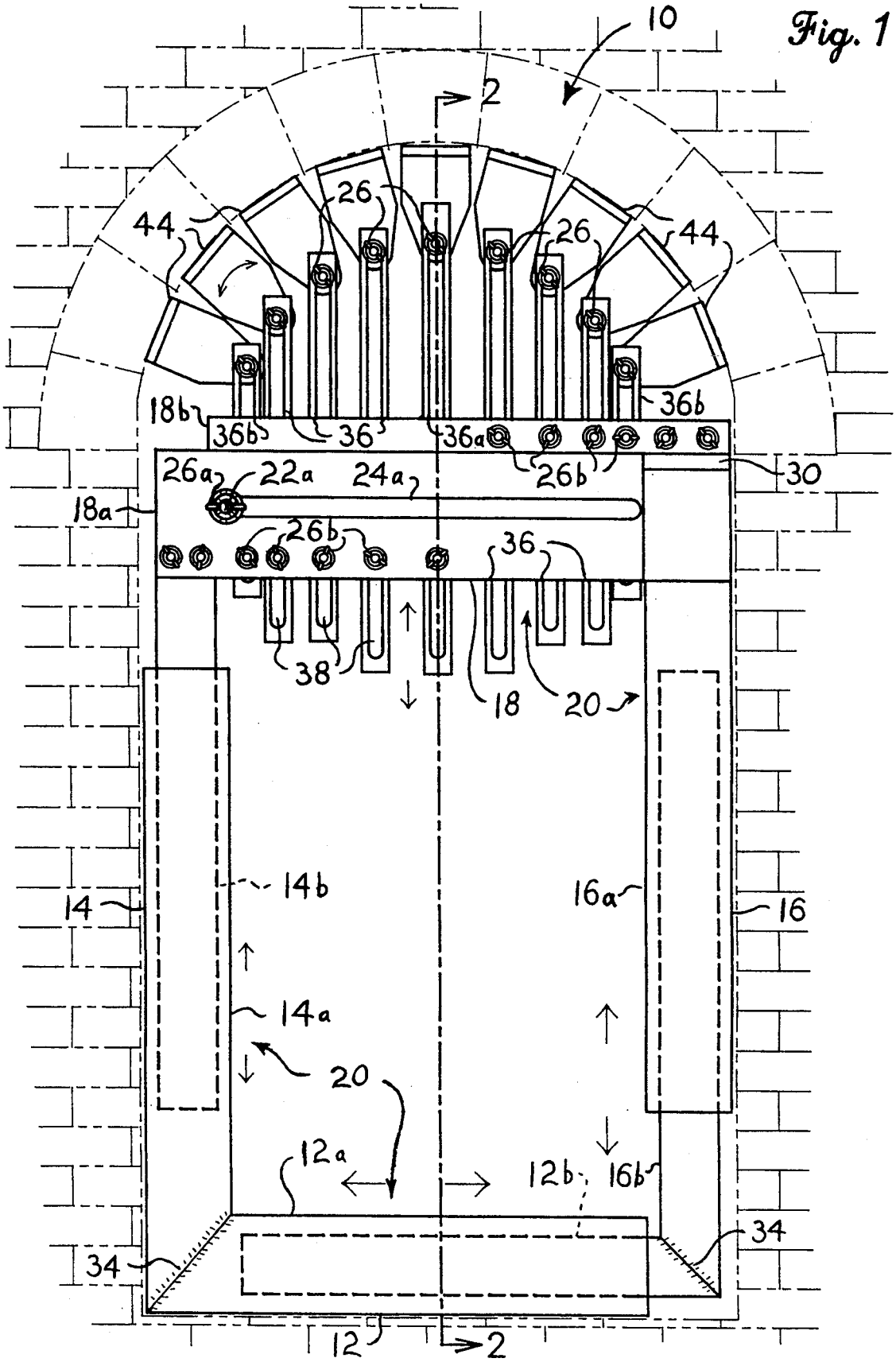
FIG. 1 is a front elevation view of the present adjustable arch support installed in an arched masonry opening, showing its various features and operation.

Referring now particularly to FIG. 1 of the drawings, the present invention will be seen to relate to an adjustable arch support 10 for use in the temporary support of a masonry arch during construction. The arch support 10 comprises a base member 12, oppositely spaced apart first and second side members 14 and 16 extending upward from the opposite ends of the base member 12, and a header 18 extending between the first and second side members 14 and 16, with the base member 12, side members 14 and 16, and header 18 comprising a substantially rectangular frame portion 20.

Figure 2:
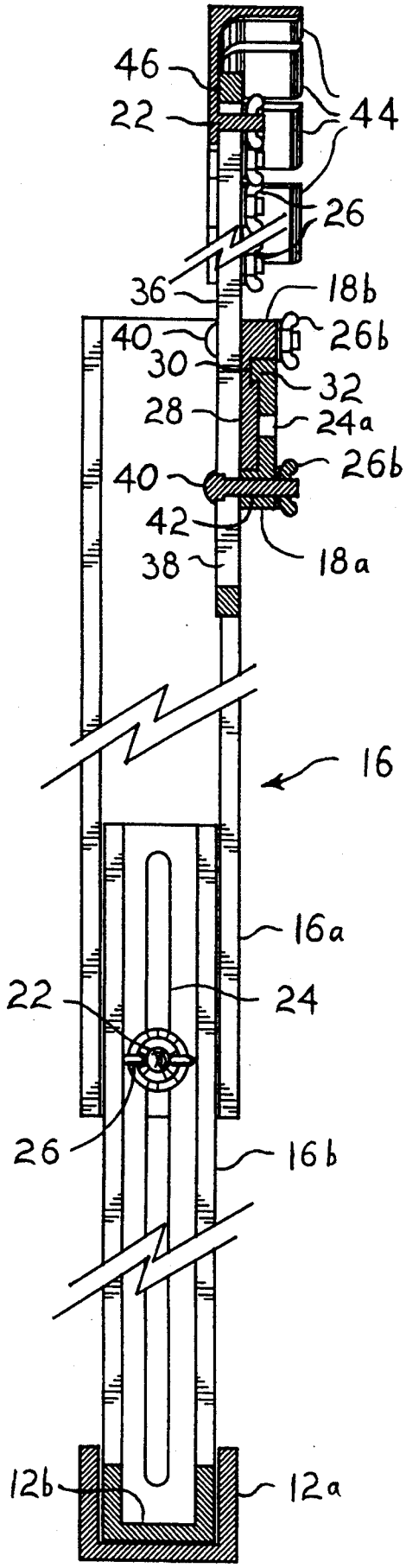
FIG. 2 is a cross sectional elevation through line 2—2 of FIG. 1, showing various details of the structure of the device.

The base member 12 and first and second side members 14 and 16 are each preferably formed of at least two cooperating channel sections, as shown in the view of the second side member 16 in FIG. 2, with a larger channel section having an inner width between the opposite side walls which closely fits the outer width of the smaller channel section across the side walls, in order to provide for the telescoping longitudinal adjustment and required longitudinal rigidity of the base member 12 and opposite side members 14 and 16. The larger channel sections of each of the telescoping components are respectively referenced as **12*a*, 14*a*, and 16*a*, while the respective smaller channel sections are referenced respectively as 12*b*, 14*b*, and 16*b*, as shown in FIG. 1. It will be noted that due to the smaller base channel section 12*b* to the right side of the frame 20, that the second side member channel section 16*b* is of like smaller size, and the uppermost second side member channel section 16*a* is of larger size to telescope over the smaller channel 16*b*. Conversely, the larger base channel member 12*a* supports a larger first side channel member 14*a*, into which the smaller first side channel member 14*b*** telescopes from above.

Figure 3:
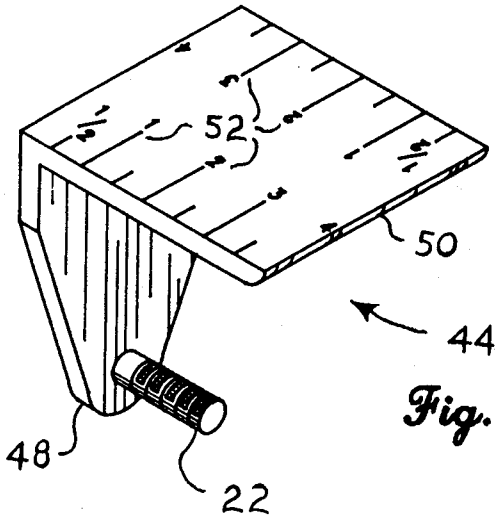
FIG. 3 is a perspective view of one of the masonry support shoes, showing its details and graduations providing for uniform offset, of a masonry arch course.

Each of the above larger channel members **12*a*, 14*a*, and 16*a* includes a threaded stud 22 projecting inwardly therefrom, as shown in FIG. 2, of a similar configuration to the threaded stud 22 of the masonry support shoe shown in FIG. 3 and discussed further below. Each of the studs 22 is preferably welded in place on the appropriate channel section 12*a*, 14*a*, or 16*a* (as well as on the masonry support shoe), to preclude unwanted turning as a fastener is applied thereto or removed therefrom. Each of the smaller channel sections 12*b*, 14*b*, and 16*b* includes a slot 24 formed therein, which slots 24 cooperate with the respective stud 22; the appropriate stud 22 passes through the respective slot 24. A threaded female fastener (e. g., a wing nut 26, allowing the tightening and removal thereof by hand without need of tools) is provided for each of the studs 22** to lock the frame together at the desired horizontal and vertical dimensions.

Figure 4:
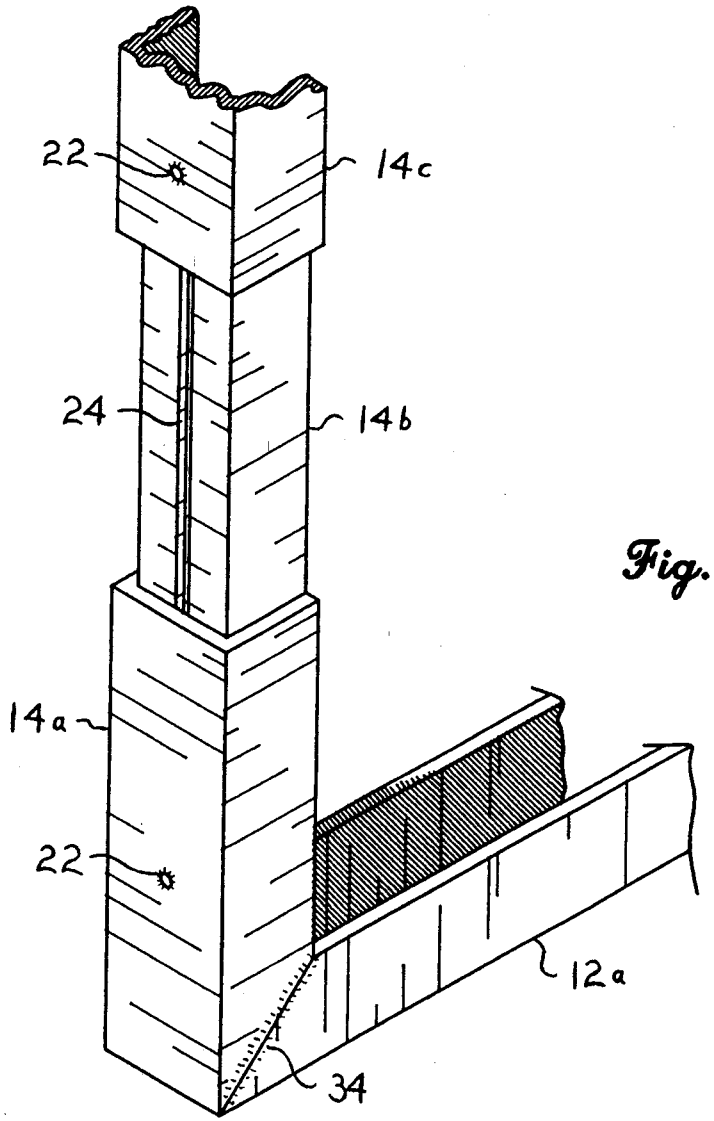
FIG. 4 is a broken away perspective view of one corner of the frame of the adjustable arch support, showing details of the telescoping channel arrangement and an alternative construction using more than two telescoping channel members.

While it is anticipated that the two telescoping sections of the base 12 and side members 14 and 16 will provide sufficient adjustment for most purposes, it will be understood that multiple telescoping sections, e. g., lower first side member **14*a*, intermediate first side member 14*b*, and upper first side member 14*c*, may be provided, as shown in FIG. 4. The interlocking of these components is identical to that described above for sections a and b of members 12, 14, and 16, but provides additional versatility for the adjustment of the frame 20** if desired. It will also be noted that the lower first section 14*a* is welded to the adjacent base section 12*a*, at weld 34. While the present adjustable arch support 10 may be assembled using mechanical fasteners, welding is preferably used for all permanent joints, in the interest of structural rigidity and strength.

The header 18 is also preferably formed of at least two longitudinally telescoping sections 18*a* and 18*b*, in order to allow the frame 20 to adjust both horizontally and vertically for differently sized openings. A cross section of the header components 18*a* and 18*b* is shown in FIG. 2. In the case of the above described channel sections 12*a*, 12*b*, 14*a*, 14*b*, 16*a*, and 16*b*, it is not necessary that they provide a uniform, coplanar front or rear surface, as no other components are secured thereto. However, in the case of the header 18, a plurality of masonry support fingers are secured to the attachment surface 28 thereof, and it is important that these masonry support fingers be in a coplanar array, for reasons to be discussed further below. Accordingly, the header 18 is formed of two sections 18*a* and 18*b* of cooperating plates, with one section 18*b* having a longitudinal slot 30 with a trapezoidally shaped cross section formed therein and the other section 18*a* having a similarly shaped longitudinal cooperating extension 32 formed therealong. The slot 30, with its relatively wider base, captures the wider top of the longitudinal extension 32 to cause the two sections 18*a* and 18*b* to interlock and thereby provide longitudinal rigidity and preclude their separation when they are assembled together even without need for mechanical fasteners. One header component 18*a* includes a slot 24*a* therein, in the manner of the slots 24 formed in the frame members 12*b*, 14*b*, and 16*b*, and serving a like function. A threaded stud 22*a* is provided in the mating header component 18*b*, in the manner of the studs 22 of the frame members 12*a*, 14*a*, and 16*a* discussed above. Thus, a wing nut 22 may be used to immovably lock the two header components 18*a* and 18*b* together, in the same manner as used for the locking together of the other frame members 12, 14, and 16.

The above described structure provides a frame 20 which is adjustable in both width and height to adapt to openings of various sizes and shapes. However, additional structure is required for the support of a masonry arch to be constructed over the present support 10. To provide support for the masonry arch itself, a plurality of vertically adjustable masonry support fingers 36 is provided, extending upward from the header 18 and adjustably secured thereto. FIG. 1 provides a general view of the support finger assembly, while FIG. 2 discloses the details of the attachment of the fingers 36 to the header 18. Each of the support fingers 36 is individually adjustable, and in fact each may be completely removed from the header 18, as may be required for relatively narrow arches. Preferably, support fingers 36 are provided in relatively long lengths 36*a* for the relatively higher center area of an arch, and in relatively shorter lengths 36*b* for the lower portions of the arch near the sides, although such differences in support finger length are not required for the function of the arch support 10. Each of the support fingers 36 includes a slot 38 therein, which slots 38 cooperate with respective carriage bolts 40 or the like extending therethrough. The carriage bolts 40 are provided with square shoulders of a width equal to that of the support finger slots 38, so that when the bolts 40 are inserted into the fingers 36, they are locked relative to rotation and cannot turn when a wing nut 26*b* or other suitable fastener is applied or removed. Each of the header components 18*a* and 18*b* includes a series of bolt passages therethrough, providing for the attachment of the support fingers 36 to one or the other of the header components 18*a* and/or 18*b*, as required for the specific application.

The above discussed structure provides for the adjustable fitting of a support frame 20 to a given opening, and for a series of adjustable fingers 36 which upper ends thereof serve to define the shape of a given arch. However, additional support is required due to the individual angle of each of the masonry blocks used to form the given arch. This additional support is provided by a plurality of masonry support shoes 44, with one shoe 44 pivotally secured respectively to the upper end 46 of each of the masonry support fingers 36. FIG. 3 provides a detailed view of one of the support shoes 44. Each of the support shoes 44 is formed of a generally L shaped member, with an attachment leg 48 of the shoe 44 having a tapered lower or inner end 48 with a threaded stud 22 extending therethrough. The taper of the attachment legs 48 provides mutual clearance for each of the adjacent coplanar support shoes 44 when they are assembled to a corresponding adjacent support fingers 36. The perpendicular masonry support leg 50 extends over the upper end 46 of the support fingers, to provide properly angled support for a masonry brick, block or other component placed thereon during construction.

All of the installed support fingers 36 are mutually coplanar due to their attachment to a single common surface 28 of the header components 18*a* and 18*b*, and extend upwardly from the header 18 to define a substantially vertical plane. Thus, it will be seen that the lower or inner ends 48 of each of the masonry support shoes 44 pivotally attached to the upper ends 46 of the masonry support fingers 36, are also coplanar and will lie in a single vertical plane common to each of the support shoes 44. This alignment in the vertical plane of each of the support shoes 44 provides further advantage in the construction of a masonry arch, as discussed below.

When a masonry arch is constructed, it is often built with the arch course offset from the plane of the outer surface of the balance of the masonry wall. Such offset is generally outward, so the arch course projects slightly outward from the wall surface. This outward offset is done for decorative purposes, as well as to provide better weather protection for the underlying lintel or other structure. The masonry support legs 50 of the support shoes 44 of the present invention may be provided with identical alignment graduations 52 thereon, which graduations 52 provide for the precise alignment of each brick, block or stone of the masonry arch course being constructed with the assistance of the present invention, due to the coplanar alignment of each of the support shoes 44. These graduations 52 may be numbered according to the distance in inches from one edge of the support shoe 44 upper legs 50, or otherwise marked as desired, so long as all of the shoes 44 assembled in a given arch support 10 are uniformly marked for consistency.

Generally when a masonry arch is constructed, a permanent frame (e. g., door, window, etc.) is installed at the proper location in the wall and the masonry courses are built up around the frame. If the frame and opening are arched, a temporary form is installed to conform to the shape of the arched frame, and at least the masonry arch course (and perhaps one to a few additional courses) is/are constructed over the form.

When the mortar, cement, or other agent has dried or cured, the form is removed. As noted above, such forms heretofore have been constructed of wood and are destroyed for removal after a single use. The present invention provides an adjustable and reusable form for such masonry arch construction.

When an arched opening is to be constructed the present adjustable arch support 10 may be horizontally and vertically adjusted, by means of the telescoping base, side and header members 12*a* and 12*b* through 18*a* and 18*b* and the locking means comprising slots 24/24*a*, studs 22/22*a*, and wing nut fasteners 26/26*a* secured to lock the frame 20 at the desired width and height. It will be noted that the fasteners 26 are all accessible from the interior of the frame 20, as the outer edge of the frame 20 will abut and be in direct contact with the masonry wall constructed to that point. The fastener 26*a* used to secure the header components 18*a* and 18*b* together at the desired width, is preferably accessible from the front of the support 10, i. e., the side of the support 10 facing toward the outside of the structure. (The orientation of fastener 26*b* is not vital, so long as it is oriented to the same side of the support 10 as other fasteners 26/26*b*, for convenience for the assembler of the support 10.)

When the frame 20 is installed as described above, an appropriate number of masonry support fingers 36 may be installed, using carriage bolts 40 with shoulders engaging the slots 38 of the support fingers 36, and the corresponding header bolt passages 42 and fasteners 26*b*. Preferably, shorter support fingers 36*b* are installed near the outer ends of the header 18, with longer support fingers 36*b* being installed near the center of the header 18, for a conventional arch construction having a relatively higher center. More or fewer fingers 36 may be installed, according to the width of the arch to be constructed, and adjusted vertically to the arch shape desired and locked in place by means of the fasteners 26*b*, which are preferably oriented to the same side of the support frame 20 as the header fastener 26*a* discussed above.

The masonry support shoes 44 are now pivotally adjusted to conform to the shape of the arch opening, by means of the threaded studs 22 projecting from the lower or inner ends 48 of the support shoes 44 and the corresponding fasteners 26. Again, preferably the support shoe fasteners 26 are oriented in the same direction as the other fasteners 26/26*a* discussed above, thereby allowing a worker to manipulate and adjust all of the various components of the present adjustable arch support 10 from one side, rather than being required to move from one side of the wall to the other for adjustments.

As the support shoes 44 are all mutually coplanar, due to their assembly to the coplanar support fingers 36 secured to the planar rear surface 28 of the header 18, any graduations 52 on the masonry support legs 50 providing for offset of the arch course will also be mutually aligned. At this point, the arch course may be constructed directly upon the masonry support legs 50 of the masonry support shoes 44, with any offset desired being made according to the uniform graduations 52 provided thereon.

The present adjustable arch support 10 is capable of supporting numerous courses of masonry, up to as many as eight to ten courses. Thus, the present arch support 10 may be left in position while additional courses are built up over the first arch course, with each succeeding course adding further compressive strength to the arch. Generally by the time several courses have been built up over the arch, the mortar, cement, or agent used has dried or hardened to the extent that the newly completed arch is self supporting, and the arch support 10 may be removed by loosening the various fasteners 26/26*a*/26*b*, collapsing the frame 20, and withdrawing it from the completed arched opening.

As the present arch support 10 is reusable, it is preferably constructed of a relatively durable and sturdy material, yet one which is relatively light weight in order to enable a single worker to hand carry the support 10 to various locations on the construction site and assemble and adjust it as required. Aluminum has been found to be an excellent material for the construction of the present adjustable arch support, with the various welds 34 of the members comprising the frame 20 being accomplished by Heliarc (tm) or other suitable welding technique. The studs 22/22*a*, which may be of a similar material, may be similarly welded in place. The use of fasteners (e. g., wing nuts 26/26*a*/26*b*) which may be Lightened and loosened by hand, precludes damage to aluminum threaded parts which might occur using tools, and allows the assembly and adjustment of the present invention without need for any other tools. Moreover, the structure of the present adjustable arch support provides a relatively smooth, easily washable and cleanable surface, enabling excess mortar, cement, etc. to be readily washed away.

Thus, the present adjustable arch support provides a temporary, reusable support for masonry arch construction, which support is transportable, assembleable, and adjustable by a single masonry worker, without need for additional workers or skills from other disciplines. The device may be easily installed, adjusted, and removed from one side of the frame, thus providing further ease of use. The broad versatility provided by the adjustment features provides for use in the construction of virtually any arch size or shape (e.g., gothic, semicircular, etc.), and its durability will be seen to provide for innumerable reuse as an indispensable tool of the masonry trade.

It is to be understood that the present invention is not limited to the sole embodiment described above, but encompasses any and all embodiments within the scope of the following claims.

1. An adjustable arch support for use in the construction of masonry arches, comprising:

a substantially horizontal base member having opposite first and second ends, oppositely spaced apart substantially vertical first and second side members extending upwardly respectively from said first and second ends of said base member with each of said side members respectively having a lower and an upper end, and a substantially horizontal header having opposite first and second ends and extending between said upper ends of said first and second side members to form a generally rectangular frame;

said header including a plurality of vertically adjustable, mutually coplaner masonry support fingers extending substantially vertically upwardly therefrom to define an interior surface of an arch, whereby;

said arch support is placed in a partially completed opening in a masonry structure and said masonry support fingers are vertically adjusted to provide support for a masonry arch constructed over the opening during arch construction.

2. The adjustable arch support of claim 1 wherein:

at least said base member and said first and second side members each comprise at least two sections of telescoping channel with each said telescoping channel including locking means therein, whereby;

said base member and said side members are lockingly adjustable to provide for a proper fit in openings of different widths and heights.

3. The adjustable arch support of claim 1 wherein:

said header comprises at least two sections of cooperating plates, with at least one section having a longitudinal slot with a trapezoidal shaped cross section having a wider base opposite a narrower opening formed therein, and at least one other section having a similarly shaped longitudinal cooperating extension formed therealong, whereby;

said extension of said at least one other section of said plate is interlockingly captured within said slot of said at least one section of plate to provide for telescoping adjustment of said header to provide for a proper fit in openings of different widths.

4. The adjustable arch support of claim 1 wherein:

each of said masonry support fingers includes a longitudinal slot therein providing for vertically adjustable attachment to said header.

5. The adjustable arch support of claim 1 wherein:

said masonry support fingers are of at least two different lengths.

6. The adjustable arch support of claim 1 wherein:

each of said masonry support fingers includes an upper end having a masonry support shoe attached thereto.

7. The adjustable arch support of claim 6 wherein:

each of said masonry support shoes is pivotally adjustable on said upper end of said masonry support fingers, whereby;

each of said masonry support shoes is adjusted to conform to the arcuate shape desired for the construction of a masonry arch.

8. The adjustable arch support of claim 6 wherein:

each of said masonry support shoes includes an upper surface on which identical graduations are inscribed to provide for horizontal alignment of masonry placed thereon during construction of a masonry arch.

9. The adjustable arch support of claim 1 wherein:

said rectangular frame of said adjustable arch support defines an interior opening therein and a plane having opposite first and second sides, with said locking means of each said telescoping channel disposed to provide access from within said interior opening of said frame;

said header comprises at least two sections including mutual locking means precluding relative movement of each of said sections, with said locking means of said header disposed to provide access from said first side of said frame;

each of said fingers includes locking means precluding movement of said fingers relative to said header, with said locking means of each of said fingers disposed to provide access from said first side of said frame, and;

each of said masonry support fingers includes an upper end having a masonry support shoe attached thereto and further includes locking means precluding movement of said masonry support shoes relative to said masonry support fingers, with said locking means of each of said masonry support shoes disposed to provide access from said first side of said frame, whereby;

a user of said adjustable arch support selectively locks and unlocks said locking means by access solely to said interior opening and said first side of said frame.

10. The adjustable arch support of claim 1 wherein:

said adjustable arch support is formed of aluminum.

* * * * *